US006950685B2

(12) United States Patent
Barras et al.

(10) Patent No.: US 6,950,685 B2
(45) Date of Patent: Sep. 27, 2005

(54) ELECTRONIC INSTRUMENT INTENDED TO BE WORN ON THE WRIST AND INCLUDING, IN PARTICULAR, AN ANTENNA FOR RECEIVING AND/OR TRANSMITTING RADIO-FREQUENCY SIGNALS

(75) Inventors: David Barras, Schlieren (CH); François Klopfenstein, Delémont (CH); Christe Laurent, Bienne (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 74 days.

(21) Appl. No.: 10/481,546

(22) PCT Filed: Jun. 18, 2002

(86) PCT No.: PCT/EP02/06745

§ 371 (c)(1),
(2), (4) Date: Dec. 19, 2003

(87) PCT Pub. No.: WO03/005485

PCT Pub. Date: Jan. 16, 2003

(65) Prior Publication Data

US 2004/0137963 A1 Jul. 15, 2004

(30) Foreign Application Priority Data

Jul. 5, 2001 (EP) ..... 01202595

(51) Int. Cl.[7] ..... H04M 1/00; G01C 17/00; G04B 47/00

(52) U.S. Cl. ..... 455/575.1; 455/556.1; 33/354; 368/10

(58) Field of Search ..... 455/575.1, 556.1; 368/10; 33/354; 702/92

(56) References Cited

U.S. PATENT DOCUMENTS 4,395,134 A 7/1983 Luce (Continued)

FOREIGN PATENT DOCUMENTS

| | | | | |
|---|---|---|---|---|
| DE | 0562522 A1 | * | 3/1993 | ..... G04B/37/04 |
| EP | 476 425 A1 | | 3/1992 | |
| EP | 871 236 A2 | | 10/1998 | |
| EP | 982 639 A2 | | 3/2000 | |
| FR | 2583897 | * | 11/1985 | ..... G04B/37/16 |

OTHER PUBLICATIONS

Patent Abstracts of Japan, vol. 005, No. 157 Oct. 8, 1981 & JP 56 089086, Jul. 20, 1981 (Seiko Epson Corp.).

*Primary Examiner*—William Trost
*Assistant Examiner*—Kiet Doan
(74) *Attorney, Agent, or Firm*—Sughrue Mion, PLLC

(57) ABSTRACT

There is disclosed an electronic instrument intended to be worn on a user's wrist, such as a wristwatch (1), including a case (2) and a wristband (2*a*) secured to the case. The case encloses an electronic module (6), a display device (5) and an electric power source (10) powering the electronic module and the display device. This instrument further includes an antenna (20) arranged in an off-centre position with respect to the centre (○) of the instrument.

The instrument is configured to be worn on the wrist in a first, so-called normal position, and in a second, so-called opposite position, rotated through 180° with respect to the first position about an axis (α) substantially perpendicular to the general plane (Π) of the electronic instrument.

The instrument further includes control means for switching the display device into a first so-called normal display mode, when the instrument is worn in the first position, and into a second so-called reverse display mode, when the instrument is worn in the second position, the data displayed by the display device being shifted through 180° from one display mode to the other.

10 Claims, 4 Drawing Sheets

U.S. PATENT DOCUMENTS 5,175,936 A * 1/1993 Sato ..... 33/354
5,331,608 A * 7/1994 Umemoto et al. ..... 368/10
5,572,488 A * 11/1996 Yamada et al. ..... 368/10
5,960,366 A * 9/1999 Duwaer ..... 455/556.1
D454,798 S * 3/2002 Gruosi ..... D10/30
6,535,461 B1 * 3/2003 Karhu ..... 368/10
6,768,957 B2 * 7/2004 Kato ..... 702/92

* cited by examiner

CROSS-SECTION A-A'

ELECTRONIC INSTRUMENT INTENDED TO BE WORN ON THE WRIST AND INCLUDING, IN PARTICULAR, AN ANTENNA FOR RECEIVING AND/OR TRANSMITTING RADIO-FREQUENCY SIGNALS

The present invention generally concerns an electronic instrument intended to be worn on a wrist and including, in particular, an antenna for receiving and/or transmitting radio-frequency signals. The present invention more particularly concerns an electronic instrument of this type, including an antenna for the reception of satellite navigation and positioning signals or GPS signals.

Patent document No. EP 0 982 639 discloses an electronic instrument intended to be worn on a user's wrist, the instrument being fitted with a patch type antenna allowing, in particular, GPS signals to be received. Various variants are presented in this document, the patch antenna being placed, in each of these variants, in an off-centre position in proximity to the display device.

The arrangement of the antenna, particularly the arrangement of an antenna for receiving signals transmitted by satellites (such as GPS signals), constitutes a critical element in the design of such a portable electronic instrument of small volume. Indeed, taking account of the high directivity of satellite transmitted signals, it is important to optimise as far as possible the arrangement of the antenna in the instrument so that it is directed essentially vertically with respect to the terrestrial plane during the satellite acquisition and tracking phase in order to allow optimum extraction of positioning and navigation data.

This constraint becomes even more critical when one wishes to make an electronic instrument of this type intended to be worn on the user's wrist, for example in the form of a wristwatch. Indeed, given the small dimensions of such an instrument and constraints imposed by the construction thereof, the antenna can only be arranged in a relatively limited number of configurations. Moreover, as a function of the position and orientation that can be taken by the user's wrist, around which the instrument is worn, the antenna is not generally continuously directed in the proper direction.

For example, if an antenna configuration is adopted such that its optimum reception position corresponds to the natural reading position for an instrument worn on the wrist (thumb of the hand oriented substantially downwards), this same configuration is no longer optimum if the person wearing the instrument is for example a runner or a cyclist for whom the natural position of the forearm is rather in a position in which the thumbs are oriented upwards. For such activities, this configuration is thus not suitable, particularly if the user wishes to store co-ordinates of various points of the path he has travelled. The same problem would arise for a person used to wearing the instrument on the inside of the wrist.

One object of the present invention is to propose a simple solution for optimising as far as possible the orientation of the antenna in an electronic instrument such as that mentioned above, given the constraints imposed by the construction of said instrument, given the activity of the user wearing said instrument on his wrist or the way in which said instrument is worn on the wrist.

Another object of the present invention is to propose such an electronic instrument with improved comfort for the user and improved ergonomics with respect to the solutions of the prior art.

The present invention thus concerns a portable electronic object, intended to be worn on the wrist, such as a wristwatch, whose features are listed in the independent claim 1.

Advantageous embodiments of the present invention form the subject of the dependent claims.

According to the invention, the antenna for receiving satellite signals is arranged in an off-centre position with respect to the centre of the instrument, in particular in a position located substantially on the periphery of the instrument. Preferably, this instrument is arranged in the longitudinal direction of the wristband of the instrument, advantageously either at 12 o'clock or at 6 o'clock with respect to the centre of the electronic instrument.

According to the invention, the instrument can be worn one way or another, i.e. in a first, so-called natural or normal position, and in a second, so-called opposite position, rotated through 180° (about an axis perpendicular to the plane of the instrument) with respect to the natural position. In order for the use of the instrument (particularly reading the displayed data) not to be affected by the position chosen by the person wearing it, the instrument according to the invention includes control means for switching the display into another mode in which the data are displayed at 180° with respect to the normal reading mode, i.e. the display mode corresponding to the instrument's natural position on the user's wrist.

Depending upon the type of activity or the way in which the user wishes to wear the instrument on his wrist, he can thus choose to wear the instrument one way or another taking care that the antenna is directed essentially vertically with respect to the terrestrial plane. The user then controls the display in order to switch it into one mode or the other so that the data displayed appear properly to him.

The invention also advantageously provides permutation of the functions of certain control members so that the user still controls the electronic instrument in the same way. In particular, the electronic instrument is preferably configured so that the control members are arranged substantially symmetrically with respect to the centre of the electronic instrument so that, when the instrument is rotated through 180°, the control members are arranged in substantially the same place.

It will be noted that there is already known, from European Patent No. 0 476 425, an analogue display timepiece able to be worn in different ways. This timepiece includes adjustment means for modifying the position, with respect to the dial, of the time reference. Thus for example, by positioning the time reference at 6 o'clock, a wristwatch intended to be worn on the left wrist is transformed into a wristwatch intended to be worn on the right wrist. It will be noted that this document is silent as to the manufacture of a portable electronic instrument including an antenna for receiving and/or transmitting radio-frequency signals. Nor does this document answer the problem to which the present invention proposes finding a solution.

Other features and advantages of the present invention will appear more clearly upon reading the following detailed description of a preferred embodiment of the invention, given solely by way of non-limiting example and illustrated by the annexed drawings, in which.

Figure 1:
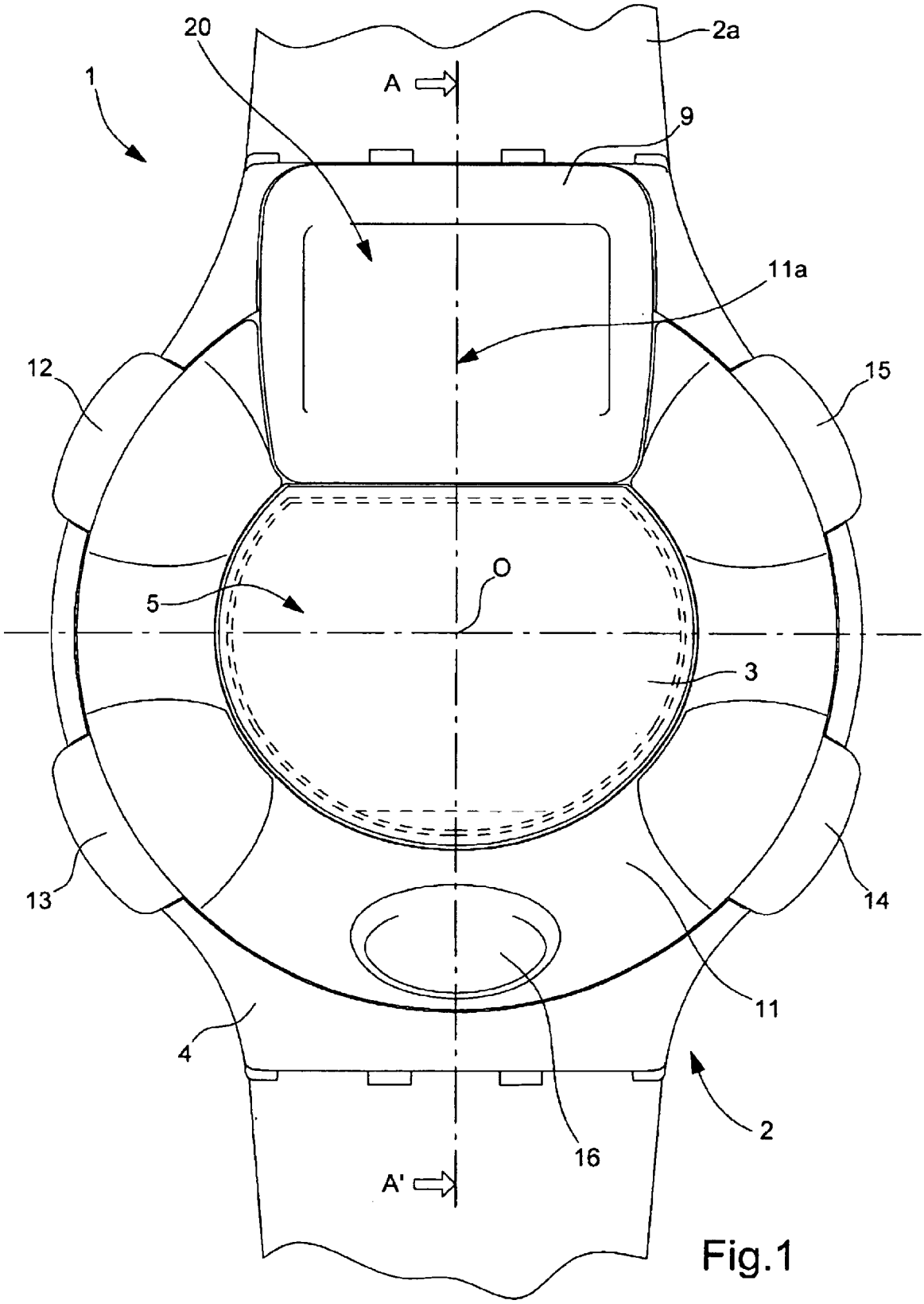
FIG. 1 is a plan view of a wristwatch forming a preferred embodiment of the invention.
Figure 2:
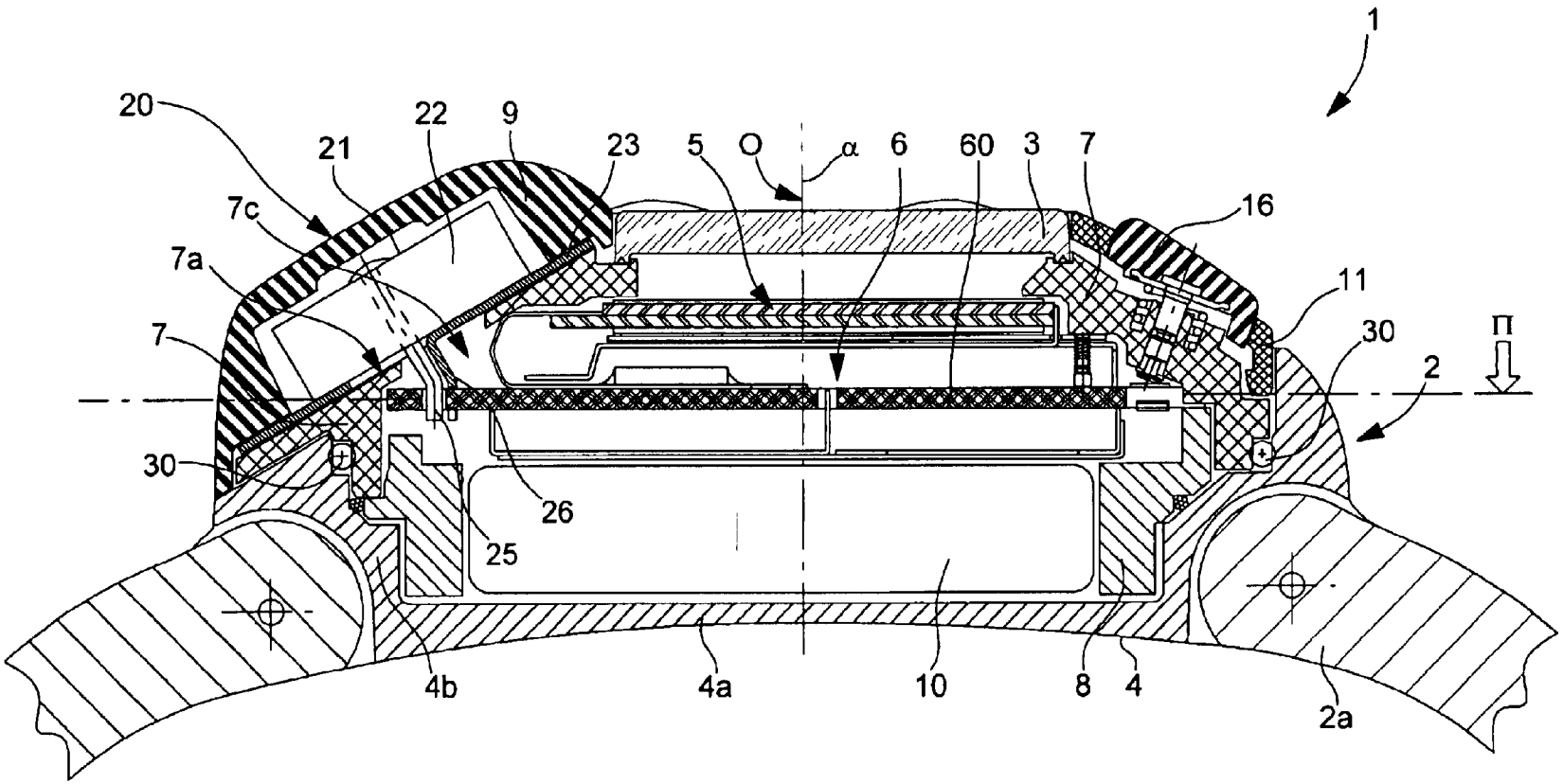
FIG. 2 is a cross-section of the wristwatch taken along the cross-section line A–A' in FIG. 1.
Figure 3A:
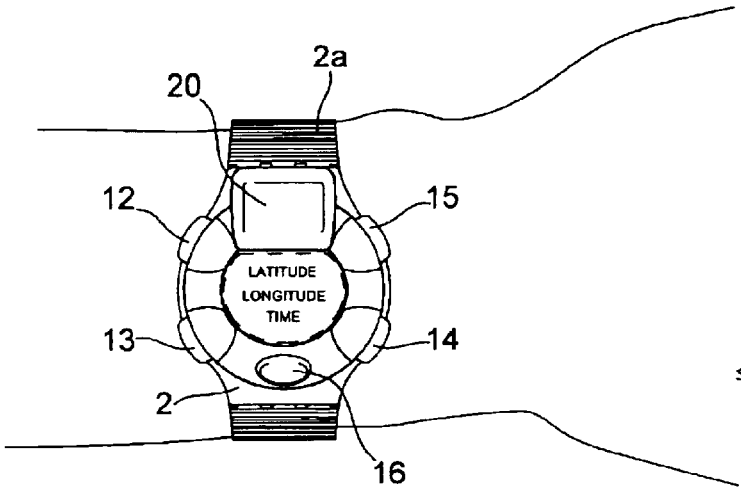
Figure 3B:
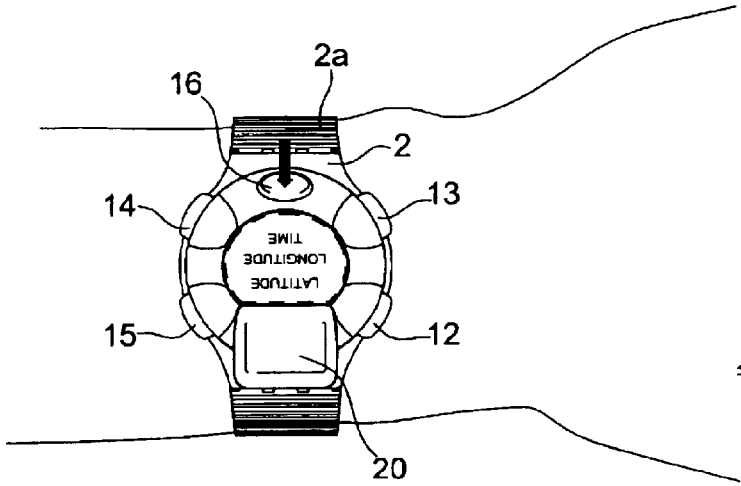
Figure 3C:
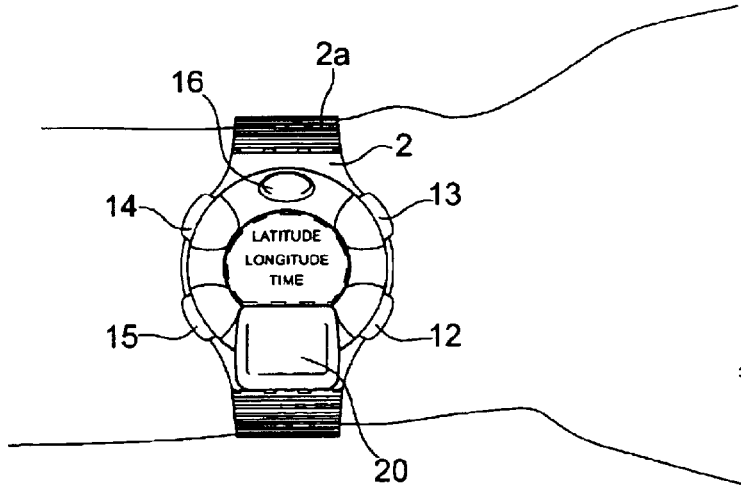
Figure 4:
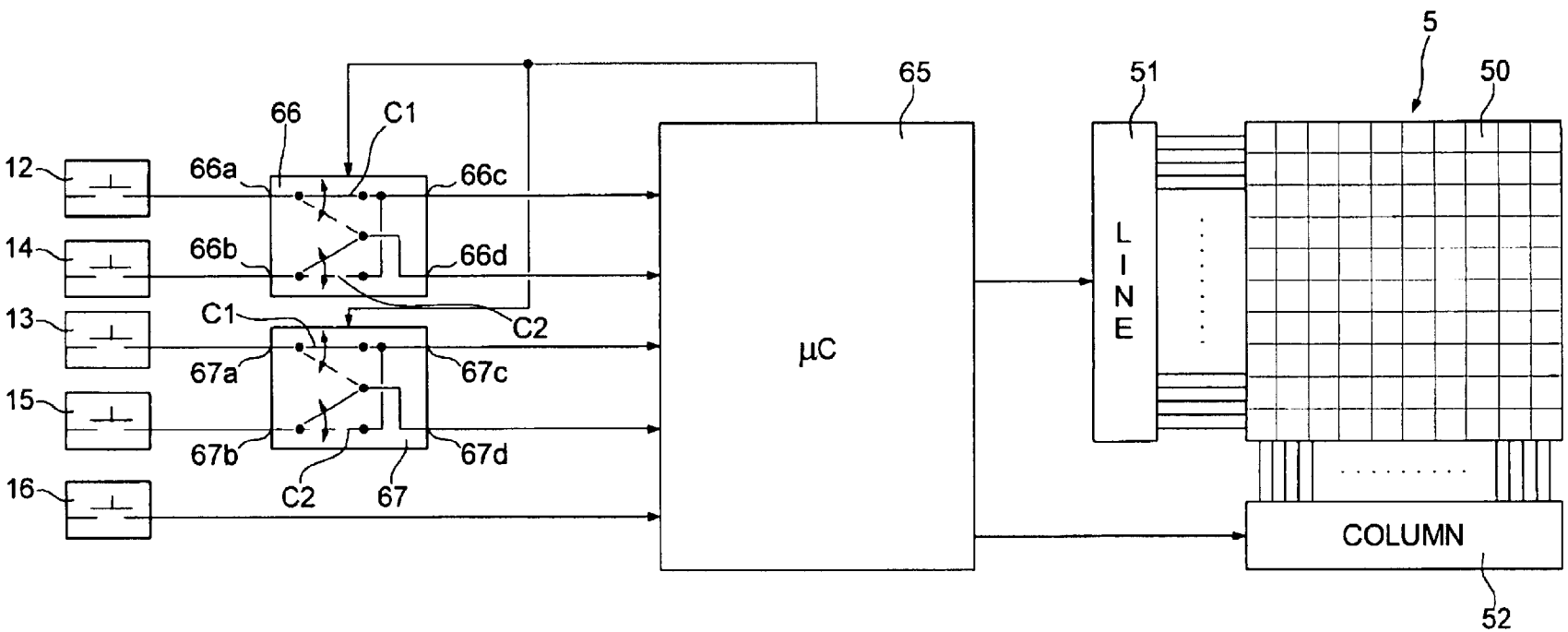

FIGS. 3*a* to 3*c* are three plan views of the wristwatch of FIGS. 1 and 2 illustrating the instrument in a first, so-called natural or normal position on the wrist, the antenna being oriented at 12 o'clock, and in a second, so-called opposite position, rotated, with respect to the normal position, through 180° about an axis substantially perpendicular to the general plane of the wristwatch, the antenna being oriented at 6 o'clock; and FIG. 4 shows schematically the means implemented for achieving the switching operations of the wristwatch display device and the permutation of the functions of the wristwatch control members.

FIG. 1 shows a plan view of a portable electronic instrument according to the invention globally indicated by the reference numeral 1 and advantageously taking the form of a wristwatch. This wristwatch 1 is fitted with an antenna 20 electrically connected to an electronic module (6 in FIG. 2) arranged inside the wristwatch. In this example, this antenna 20 is intended to allow reception of radio-frequency signals transmitted by one or more distant transmission sources. More particularly, this antenna is intended to allow reception of satellite positioning and navigation signals, such as GPS signals (Global Positioning System) originating from the American system NAVSTAR or other similar satellite positioning signals such as the Russian system GLONAS or the future European satellite positioning system GALILEO.

Wristwatch 1 has a similar general appearance to a conventional wristwatch and includes, in addition to antenna 20, a case globally designated by the reference numeral 2, a wristband 2*a* attached, via each of its ends, to case 2, a crystal 3 under which there is arranged a display device 5 enclosed in case 2 (such as a liquid crystal display) and control members 12 to 16, namely five push-buttons, one (16) placed at 6 o'clock and the other four (12 to 15) on the periphery of case 2. Control members 12 to 15 are advantageously placed in a substantially symmetrical manner with respect to the centre, designated ○, of wristwatch 1.

FIG. 2 shows a cross-section of the wristwatch 1 illustrated in FIG. 1 taken along the cross-section line A–A' parallel to the 6 o'clock–12 o'clock axis and passing through the centre ○ of the wristwatch. One can see case 2, crystal 3, display device 5, antenna 20 and push-button 16 placed at 6 o'clock. Wristwatch 1 further includes, arranged inside case 2, an electronic module 6 including, in particular, a printed circuit board 60, on which are mounted the various electronic and electric components of the instrument, as well as an electric power source 10 powering, in particular, electronic module 6 and display device 5. In this example, power source 10 is formed of a rechargeable accumulator placed in the back cover of case 2. This power source 10 could however be formed of a conventional battery (in which case a battery compartment would have to be provided preferably in the back cover of the case in order to allow it to be changed) or any other source capable of providing a suitable electric power supply.

Case 2 preferably includes an exterior body 4 with a bottom or back cover 4*a* and lateral walls 4*b*, as well as a bezel element 7 fitted onto the lateral walls 4*b* of exterior body 4. Bottom 4*a* and lateral walls 4*b* are preferably made in a single part, although one could envisage providing two distinct parts assembled to each other, and together forming, in this example, a back cover—middle part of wristwatch 1 to which the wristband 2*a* is typically attached.

Bezel element 7 is fitted onto exterior body 4 in an impervious manner (an ○ ring joint 30 being placed between a shoulder arranged on the periphery of element 7 and a similar shoulder arranged on lateral walls 4*b* of exterior body 4), and supports crystal 3, the latter being preferably welded or bonded onto element 7. Advantageously, this bezel element 7 is made of plastic material, and crystal 3 is for example welded by a known ultrasound method.

An additional element 8 forming a casing ring is also arranged in case 2 between bezel element 7 and bottom 4*a* of exterior body 4. This element 8 is secured to bottom 4*a* by fixing means, which are not shown.

Elements 7 and 8 in a sense form the upper and lower parts of a container inside which display device 5 and electronic module 6 are enclosed. Power source 10 is arranged between casing ring element 8 and bottom 4*a* of exterior body 4. It will easily be understood that this accumulator could alternatively be enclosed between elements 7 and 8 with display device 5 and electronic module 6.

In the example illustrated, antenna is advantageously arranged at 12 o'clock and in an inclined position with respect to the plane, designated H, in which display device 5 is located. Consequently, the antenna is advantageously oriented substantially upwards in order to optimise reception of the GPS signals for the natural position of the wrist when the user reads data on display device 5. More specifically, antenna 20 is mechanically supported by bezel element 7 and rests on an outer surface, designated 7*a*, of said element.

In FIG. 2, it can be seen that antenna 20 is a patch type antenna, i.e. an antenna of substantially parallelepiped shape including a radiating element 21 separated from a ground plane 23 of greater dimensions by a dielectric 22, such as a ceramic element. Radiating element 21 is excited by an excitation or feed conductor 25 insulated from ground plane 23 and passing through dielectric 22 to be connected to electronic module 6, element 7 being provided with an aperture 7*c* allowing the passage of feed conductor 25. Ground plane 23 is electrically connected to the electronic module by a separate ground conductor 26, which also passes through aperture 7*c*. Patch type antennae are commonly used and have the advantage of simple construction and low manufacturing costs.

Preferably, exterior body 4 is made of a metal material and bezel element 7 and element 8 forming the casing ring is made of plastic material. As illustrated in FIGS. 1 and 2, the wristwatch further includes, in this example, an exterior element 11, of essentially annular shape fitted onto bezel element 7, here by snap-fitting, in order to cover it. This annular exterior element 11 is preferably made in a similar metal material to the material used to make exterior body 4 and has an aperture 11 a (indicated in FIG. 1) in which antenna 20 is housed. A protective cap 9 made of dielectric material is also added to bezel element 7 in order to protect antenna 20 from the external environment. Alternatively, it will easily be understood that annular exterior element 11 and protective cap 9 could be made in a single part and of a material which does not disturb the operation of antenna 20.

We will not dwell here on the particular construction of the instrument illustrated in FIGS. 1 and 2, this construction forming the subject of a parallel application filed by the present Applicant. The essential here is that antenna 20 is arranged in an off-centre position, in this example on the periphery of the wristwatch.

FIGS. 3*a* to 3*c* show three plane views of the wristwatch of FIGS. 1 and 2 illustrating the instrument in a first, so-called natural or normal position on the wrist, with the antenna oriented at 12 o'clock, and in a second, so-called opposite position, rotated, with respect to the normal position, through 180° about an axis $\alpha$ (cf. FIG. 2) substantially perpendicular to the general plane n of the wristwatch, with the antenna oriented at 6 o'clock.

More specifically, FIG. 3*a* shows the wristwatch in the normal position on the wrist, with the antenna at 12 o'clock, the display device 5 displaying data (for example latitude and longitude data derived from the GPS signals and the time) in a so-called normal display mode corresponding to the normal position of the wristwatch on the wrist. FIGS. 3*b* and 3*c* illustrate this same wristwatch in the opposite position, the display being respectively in the normal display mode of FIG. 3*a* and in a reversed display mode where the data is displayed at 180° with respect to the normal display mode.

According to the invention, a user who wishes to undertake an activity requiring antenna 20 to be oriented at 6 o'clock in order to receive the required electromagnetic signals (for example GPS signals) in the best conditions first of all positions his wristwatch in accordance with the illustration of FIG. 3*b*. The user then switches display device 5 into the so-called reverse display mode via suitable action on one or more of the control members 12 to 16. By way of non-limiting example, such switching can be activated following prolonged action on push-button 16 placed on the frontal part of wristwatch 1.

Advantageously, in addition to switching display device 5 from the normal mode and vice versa, it is advantageous also to invert the function of certain control members. In particular, the wristwatch presented as the preferred embodiment of the present invention is configured such that the four push buttons 12 to 15 are arranged on the periphery symmetrically with respect to centre ○ of the wristwatch. Consequently, control members 12 and 13 occupy respectively the place of control members 14 and 15 (and vice versa) in the normal and opposite positions illustrated in FIGS. 3*a* to 3*c*. It is thus advantageous to invert the functions of control members 12 and 14, on the one hand, and 13 and 15 on the other hand, during passage from the normal position to the opposite position and vice versa.

Although the embodiment illustrated refers to push-button type control members, it should be noted that other types of control members may be used, such as a joystick, track ball, touch-sensitive keys or any other suitable type of control member. These control members may implement electromechanical, magnetic, inductive, piezoelectric, optical detection means or any other type of transducer able to transform a user's manual action into an electric signal.

Thus, in the case of use of a joystick, a track ball, or any other type of control member able to undergo axial movement, pivoting or rotation along at least two opposite directions (north-south, east-west movement, rotation in the clockwise and anticlockwise directions), the switching of the display device may be accompanied by inversion of the functions of the control member, i.e. inversion of the activating direction of the control member.

FIG. 4 shows schematically the means implemented for achieving the aforementioned operations, namely, first the switching of the display device from one display mode to another, and secondly, the inversion of the functions of control members 12 to 15.

FIG. 4 thus illustrates, in particular, push-buttons 12 to 16 of the wristwatch, display device 5, a microcontroller or microprocessor 65, responsible for processing manipulations on the push-buttons and controlling data and information that has to be displayed on display device 5, and two hand units 66 and 67 for inverting the functions of the push-button pairs 12–14 and 13–15.

Display device 5 used in the present invention is preferably a matrix type liquid crystal display including a crossed arrangement, designated 50 of line electrodes and column electrodes. This type of display is a common type and will consequently not be described in detail here. It will simply be noted that this type of matrix display device commonly includes line signal generating means, designated by the reference numeral 51, and column signal generating means, designated by the reference numeral 52, these generating means both being controlled as a function of the data to be displayed transmitted by microcontroller 65.

The shifting of the matrix display through 180° from one display mode to the other can easily be achieved by reversing the display line control, i.e. by instructing line signal generating means 51 such that the line signals are applied to the corresponding line electrodes from the first to the last or from the last to the first line depending upon whether the display mode selected is the normal or reversed mode.

It is important to note that the use of a matrix type liquid crystal display is preferred but that it is not, however, limiting. Indeed, one may perfectly well conceive of using a display which does not have a regular electrode arrangement such as a segment type display. Preferably, care will have to be taken as to the display device (in particular the electrodes) or at least of a part of the display device, so that it allows the display of data which can be read in both positions of the wrist watch, normal and reversed.

It will be noted that the display device may include, if necessary, an additional analog display device for displaying the time. Should it be the case, means should be provided for adjusting the time reference position of the hands (position at midday). In order to do this, those skilled in the art may for example refer to European Patent Application No. 0 476 425 cited in the preamble.

As regards the inversion of the functions of the control members, this operation may easily be achieved by means of the aforementioned two hand units 66, 67. The push-button pairs 12–14 and 13–15 are thus respectively connected to the first hand unit 66 and to the second hand unit 67. Each hand unit 66, 67 is controlled by an output of microcontroller 65 in response to the switching action made by the user, for example, via frontal push-button 16.

Each hand unit 66, 67 has the function of redirecting the signals originating from the associated pair of push-buttons on corresponding inputs of microcontroller 65 as a function of the manipulation made by the user. As can be seen schematically in FIG. 4, each hand unit includes first and second switches C1, C2 for redirecting the inputs 66*a*, 66*b* (respectively 67*a*, 67*b*) respectively on the outputs 66*c*, 66*d* or 66*d*, 66*c* (respectively 67*c*, 67*d* or 67*d*, 67*c*) as a function of the mode chosen.

It will be understood generally that various modifications and/or improvements that are obvious to those skilled in the art can be made to the embodiment described in the present description without departing from the scope of the invention defined by the annexed claims. In particular, the present invention is not limited to a wristwatch or to a portable instrument including a patch type antenna. This patch antenna nonetheless constitutes an example of an antenna perfectly suited to receiving satellite positioning signals, the construction of which is very simple and inexpensive.

It will also be understood that the particular arrangement of the antenna illustrated in the Figures is in no way limiting. It is thus perfectly possible to conceive of placing the antenna in another position, for example at 3 o'clock or at 9 o'clock.

Finally, it will be understood that the present invention is not limited to an electronic instrument for receiving satellite navigation and positioning signals, the problem of orienting the antenna and/or the ergonomics of the instrument being able to arise in a similar manner in other applications.

What is the claimed is:

1. An electronic instrument intended to be worn on a user's wrist including a case and a wristband attached to said case, said case enclosing an electronic module, a display device and an electric power source for powering said electronic module and said display device, this electronic instrument further including an antenna arranged in an off-centre position with respect to the centre of said portable electronic instrument, wherein said electronic instrument is configured to be able to be worn on the wrist in a first, so-called normal position, and in a second, so-called opposite position, rotated through 180° with respect to said first position about an axis substantially perpendicular to the general plane of said electronic instrument, and wherein said electronic instrument further includes control means for switching said display device into a first, so-called normal display mode, when said electronic instrument is worn in said first position, and into a second, so-called reverse position, when said electronic instrument is worn in said second position, the information displayed by said display device being shifted by 180° from one display mode to the other.

2. The electronic instrument according to claim 1, wherein said display device is a matrix type liquid crystal display device including an arrangement of line and column electrodes, and wherein the control of said line electrodes is reversed from one display mode to the other.

3. The electronic instrument according to claim 1, further including one or more control members and wherein said control means also invert the functions of one or more of said control members.

4. The electronic instrument according to claim 3, wherein control members are arranged symmetrically with respect to the centre of the electronic instrument.

5. The electronic instrument according to claim 1, wherein said antenna is arranged in an off-centre position in the longitudinal direction of the wristband, either at 12 o'clock or at 6 o'clock with respect to the centre of said electronic instrument.

6. The electronic instrument according to claim 5, wherein said antenna is further arranged in an inclined position with respect to the general plane of said electronic instrument.

7. The electronic instrument according to claim 1, wherein said antenna is arranged on a bezel part of said case.

8. The electronic instrument according to claim 1, wherein said antenna is a patch type antenna including a radiating element separated from an ground plane by a dielectric.

9. An electronic instrument intended to be worn on a user's wrist including a case and a wristband attached to said case, said case enclosing an electronic module, a display device and an electric power source for powering said electronic module and said display device, this electronic instrument further including a patch antenna arranged in an off-centre position with respect to the centre of said portable electronic instrument, said patch antenna being arranged in an inclined position with respect to the general plane of said electronic instrument, wherein said electronic instrument is configured to be able to be worn on the wrist in a first, so-called normal position, and in a second, so-called opposite position, rotated through 180° with respect to said first position about an axis substantially perpendicular to the general plane of said electronic instrument, and wherein said electronic instrument further includes control means for switching said display device into a first, so-called normal display mode, when said electronic instrument is worn in said first position, and into a second, so-called reverse position, when said electronic instrument is worn in said second position, the information displayed by said display device being shifted by 180° from one display mode to the other.

10. An electronic instrument intended to be worn on a user's wrist including a case and a wristband attached to said case, said case enclosing an electronic module, a display device and an electric power source for powering said electronic module and said display device, this electronic instrument further including an antenna arranged in an off-centre position with respect to the centre of said portable electronic instrument and one or more control members, wherein said electronic instrument is configured to be able to be worn on the wrist in a first, so-called normal position, and in a second, so-called opposite position, rotated through 180° with respect to said first position about an axis substantially perpendicular to the general plane of said electronic instrument, wherein said electronic instrument further includes control means for switching said display device into a first, so-called normal display mode, when said electronic instrument is worn in said first position, and into a second, so-called reverse position, when said electronic instrument is worn in said second position, the information displayed by said display device being shifted by 180° from one display mode to the other, and wherein said control means also invert the functions of one or more of said control members.

* * * * *